United States Patent [19]

Niedermeyer

[11] 4,177,021

[45] Dec. 4, 1979

[54] THROUGH FLOW SUMP PUMP

[76] Inventor: Karl O. Niedermeyer, 17W068 North St., Bensenville, Ill. 60106

[21] Appl. No.: 793,402

[22] Filed: May 3, 1977

[51] Int. Cl.[2] ..... F04B 17/00; F04B 35/04

[52] U.S. Cl. ..... 417/424

[58] Field of Search ..... 417/44, 360, 423, 424, 417/422; 285/174

[56] References Cited

U.S. PATENT DOCUMENTS

| | | | |
|---|---|---|---|
| 2,492,141 | 12/1949 | Gaylord | 417/423 |
| 2,689,529 | 9/1954 | Wightman | 417/422 |
| 3,126,831 | 3/1964 | Deters | 417/422 |
| 3,348,862 | 10/1967 | Leopold, Jr. et al. | 285/174 |
| 3,443,519 | 5/1969 | White | 417/366 |
| 3,716,309 | 2/1973 | Mitchell | 417/422 |
| 3,802,806 | 4/1974 | Blum | 417/424 |
| 3,861,831 | 1/1975 | Rule | 417/424 |

FOREIGN PATENT DOCUMENTS

| | | | |
|---|---|---|---|
| 670772 | 9/1963 | Canada | 417/360 |
| 853616 | 7/1960 | United Kingdom | 417/424 |
| 1391410 | 8/1972 | United Kingdom | 417/424 |

*Primary Examiner*—William L. Freeh
*Attorney, Agent, or Firm*—Darbo & Vandenburgh

[57] ABSTRACT

A sump motor is mounted in a section of pipe. The motor is a standard motor having special caps at each end of the motor shell and with the shell forming a waterproof enclosure. The caps have radially extending spacers extending out to the pipe. At each end of the pipe are reducers, the internal diameter of the small ends of which correspond to the external diameter of another, smaller standard pipe size. At the bottom a piece of pipe of the smaller size extends inwardly of the reducer to a location in juxtaposition to the pump impeller. Various connections and mounting arrangements may be made using standard sizes of pipe. In one embodiment the pump is mounted on a vertical track and positioned above a sump. When the water rises to a level in the sump at which pumping should commence, the motor is energized and the pump is lowered along the track into the sump.

16 Claims, 10 Drawing Figures

THROUGH FLOW SUMP PUMP

BACKGROUND AND SUMMARY OF THE INVENTION

While the present invention is primarily concerned with emergency sump pumps, features thereof can be utilized in pumps for other purposes.

Two important requirements of emergency sump pumps are that they be reliable, that is, they perform when required, and that they have high performance. For example, when storm water is accumulating in a sump, it is very important that that water be removed to prevent the damage that would otherwise be caused by the water overflowing the sump. Since such emergency pumps are operated only infrequently the existence of a condition which would cause pump failure may not be detected until the emergency occurs. Thus the feature of reliability is most significant. When the emergency occurs, water may be entering the sump quite rapidly, thus the necessity for high performance.

Another important attribute for a sump pump is that of adaptability to a wide variety of installation requirements. The configuration, size, etc., of the sump will be different in almost every instance. In fact, in some instances the basement floor drain may be the structure that might be referred to as the sump. Also, the pump capacity, the type of electric power to be employed, etc., will vary from job to job. To meet the varied requirements with a minimum of inventory, it is important to the pump supplier to have pump components which can be varied to meet the requirements of a particular job. Thus, for example, on one job the purchaser may want to use a 12 volt motor powered by a standby battery while on the next job a person may want to utilize 110 volt house current. If the supplier can merely interchange basic electric motors, and render them waterproof and utilizable with the other pump components, it is not necessary that the supplier stock every type of pump that might be required. This is only illustrative and the same applies to other components necessary to satisfy various installation requirements.

As is almost always the case, the element of cost also is an important factor to be considered. The business is a competitive business and where the manufacturing cost of the emergency sump pump is high, it may be that the product cannot be sold in competition with units of other designs. For example, many sump pumps utilize special castings for the pump, etc.

Thus, the object of the present invention is to produce a versatile, relatively low cost emergency sump pump which will have a high degree of reliability. Various features of the present invention contribute toward this end. For example, standard electric motors of diverse electrical characteristics (voltage, power, etc.) are converted into waterproof motors by substantially only the addition of a pair of end caps. These end caps also provide the necessary standard mountings for mating with the other pump components. This waterproof motor is then mounted inside a length of pipe of a standard size. Reducers on each end of that length of pipe provide for the adaptability of the pump to mate with other standard sizes of pipe utilized for the intake and discharge connections. At the intake end provision is made for the mounting of a screen when desired, which screen is formed from a standard length of pipe and also may serve as the pump support.

An important feature of the invention is that the water being pumped flows about the motor shell. Thus when in use, the motor is constantly being cooled by that water. This increases the efficiency and permits the motor to be worked at a capacity that otherwise might cause excessive heating. The spacers used to position the pipe through which the water is flowing serve as cooling fins. This arrangement, in conjunction with the type of impeller employed, also prevents the downflow of water which occurs, in the absence of a check valve, when the motor is turned off from causing an undesired, and undescribable, rotation of the motor. Pumping efficiency also is assisted in one embodiment by providing a readily accessible adjustment by which the spacing between the inner end of the intake tube and the impeller may be established after assembly.

Embodiments of the invention are relatively small and lightweight considering their pumping capacity. Their structure is such that maintenance is easily performed, both in the shop and in the field.

In one embodiment the pump is mounted externally of the sump and provision is made for automatically dropping the pump into the sump when the necessity for water removal occurs.

Other features of the invention will be mentioned and will be apparent from the following description of specific embodiments.

DESCRIPTION OF THE DRAWINGS

FIG. 4 is an elevational view of the pump of FIG. 1 installed in a floor drain or the like;

DESCRIPTION OF SPECIFIC EMBODIMENTS

Figure 1:
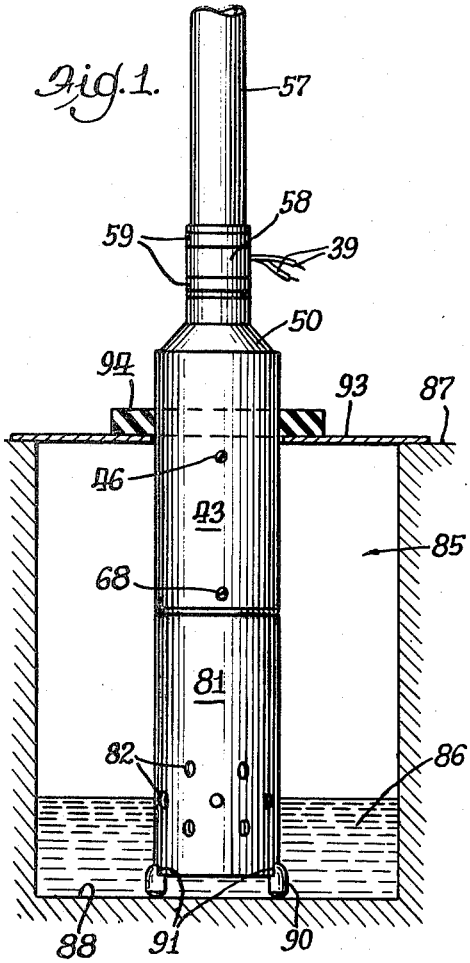
FIG. 1 is an elevational view of an embodiment of the invention positioned in a sump.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The pump motor, generally 10, comprises an electric motor of standard manufacture to which two caps and seals have been added to produce a waterproof motor. The term "waterproof" is used herein to signify that under normal operating conditions water will not enter the motor. Such a standard electric motor comprises an armature 11 mounted on a shaft 12. For use in connection with the present invention, it is desirable that the shaft be stainless steel. It has a frame formed by a cylindrical shell 13, two end plates 14, and threaded rods 15, with nuts at the upper ends which hold the end plates seated against the ends of the shell. The end plates form mountings for the shaft bearings 16. Mounted in the frame is the field coil 17 and, where appropriate, the mountings for the brushes (not shown) supplying the electrical connection to the armature. The motor shown is purely for the purposes of illustration and in actual practice it may be one of a variety of known types of electric motors of diverse electric power supply requirements and output capacities.

To such a motor I have added two end caps 20 and 21. These caps are bronze castings and have skirts 22 and 23; respectively, which extend about shell 13 in juxtaposition thereto. O-rings 24 provide a fluid seal between the end caps and the motor shell 13 thereby forming a fluid-tight motor housing. The lower end cap has an integral nose 26 with an opening 27 through which the shaft 12 extends. At the distal end of the nose are an O-ring 28 and shaft seals 29 and 30 to prevent fluid from entering about the shaft. The O-ring blocks water from flowing between the outside of the shaft seals and the cap 21. It often is preferable to put the O-ring between the two seals to hold it securely in place.

Cap 20 has a threaded bore 31 in axial alignment with each of rods 15. At the base of each bore is a wall 32 through which the rod extends. The rods are screwed into threaded blind holes 33 in cap 21. Pipe caps 34 are screwed into the threaded bores 31 to prevent fluid from entering into the motor about the rods 15.

Coaxial with the motor shaft there is a threaded bore 36 in cap 20. An electrical fitting 37 is mounted in this bore. It has a compression cap 38 about a rubber insert (not shown) through which the motor wires 39 extend. When the cap is tightened onto the fitting, it compresses the rubber insert about the wires to prevent any entry of fluid thereabout into the motor. The upper end of motor shaft 12 has a screwdriver slot 35 permitting the shaft to be rotated by a screwdriver inserted through bore 36 after fitting 37 (or the rubber insert thereof) has been removed.

A plurality of bosses 41 and 42 project radially outward from caps 20 and 21, respectively, to contact the interior of a pipe 43 which defines the motor and pump chamber 44 between the two reducers 50 and 51 to accommodate the motor 10 and the pump impeller 73. These bosses serve as spacers to position the motor from the inside of the pipe walls so that there is a water passageway around substantially the circumference of the motor, in that part of the motor and pump chamber 44 between the motor and the pipe. While there are four such bosses on each cap in the illustrated embodiment, the number and positioning will depend upon the desires of the manufacturer. At least some (the number depending upon the preferences of the manufacturer) of the bosses have blind, tapped openings 45 extending radially inward from the distal end of the boss. Screws 46 are inserted through openings 47 in pipe 43 and screwed into openings 45 to affix the motor in the pipe.

Some manufacturers may desire to originally form bosses 41, 42 with a relatively long radial dimension. The bosses of some caps are thereafter cut off to a length to conform to the internal radius of one size of pipe and others to conform to the internal radius of another pipe size.

One feature of the embodiment of FIGS. 1–4 is that many of the components of the complete pump are formed of standard sizes of plastic pipe. Thus, for example, the main pipe 43 is a length of "four inch" plastic pipe forming a pump shell. That is, it has a four inch internal diameter and a four and one-quarter inch external diameter. In such instance the distance from the axis of the motor, as represented by shaft 12, to the distal ends of the bosses 41 and 42 is two inches. The pipe used is polyvinyl chloride. The smoothness of the pipe and the finished pump makes it easy to clean and there is little problem with a buildup of debris thereon.

At each end of the main pipe 43 are reducers 50 and 51. In the illustrated embodiment, these are identical, but this need not necessarily be the case. Reducer 50 comprises a large cylindrical sleeve 52, a connecting truncated conical section 53 and a small cylindrical sleeve 54, all as a unitary section. Large sleeve 52 telescopes into the end of main pipe 43, and thus has an external diameter corresponding to the internal diameter of the pipe (four inches in the example given). The internal diameter of the small sleeve 54 is such as to telescopically receive a piece 56 of pipe of another standard size, smaller than that from which pipe 43 was formed. In the example given, pipe 56 is a piece of "one and three-quarter inch" plastic pipe; i.e., having an internal diameter of one and three-quarter inches and an external diameter of one and seven-eighths inches. Thus the internal diameter of sleeve 54 is one and seven-eighths inches.

Reducer 50 is suitably secured to pipe 43. In the illustrated embodiment this is done by use of an adhesive, but other fastening means might be employed. Pipe 56 is similarly affixed to reducer 50. Pipe 56 forms a part of the discharge passageway for the liquid being pumped. It is connected to another pipe 57 (metal or plastic) of a similar size and leading to a suitable discharge point. This connection is formed by a piece of rubber hose 58 which is secured to pipes 56 and 57 by means of hose clamps 59. In the conventional manner the hose clamps have means, not shown, for tightening the clamps about the hose.

The distal end of pipe 56 has a slot 61 formed in one side thereof, in the illustrated embodiment this slot being formed by beveling the end of the pipe. Adjacent this slot are two holes 62 in hose 58. The wires 39 from the motor extend through this slot and through the holes 62, the fit of the hose about the wires being sufficiently tight to prevent water leakage at that point. Because of the slot 61 it is not possible for the installer to pinch wires 39 when connecting pipe 57 to the pump. Pipe 57 will abut the apex of the tapered end of pipe 56 and thus prevent the wires from being pinched.

Similarly, reducer 51 is a unitary element made up of a large cylindrical sleeve 64, small cylindrical sleeve 65 and a truncated conical section 66 therebetween. The external diameter of the large cylindrical sleeve 64 is such as to telescope within main pipe 43. The internal diameter of the small cylindrical sleeve 65 is such as to telescopically receive a piece of pipe 67 of another of the standard sizes; in the example given, it being a one and three-quarter inch pipe. The large cylindrical sleeve is removably affixed to the main pipe 43. In the illustrated embodiment this is done by means of screws 68 which extend through openings 69 in main pipe 43 and are threaded into openings 70 in the reducer 51. An O-ring 71 forming a seal is seated in a groove in sleeve 64 at the end of main pipe 43.

Pipe or tube 67 serves as the intake conduit for the pump. It extends to within a short distance of the pump impeller 73 and is coaxial therewith. It frictionally engages sleeve 65 and thus can be adjusted with respect to the impeller. A plastic pipe coupling 74 is slipped onto the external end of the pipe 67. In some embodiments the small cylindrical sleeve 65 would be extended axially for a sufficient distance to serve the function of the separate coupling 74, which would then be eliminated. A draw pipe 75 of the desired length, etc., is fitted into coupling 74 in the field. The slanting of the bottom of the draw pipe ameliorates the problem of accidental blockage of the intake opening. Were it desired to pump down to a low level in the pit the bottom of the draw pipe would be normal to the axis of the pipe (as is draw pipe 75').

Impeller 73 comprises a flat plate 77 which effectively covers the end of opening 27 in the motor and prevents water from being forced directly at the seals 28–30. Extending downwardly from plate 77 are a plurality of vanes 78. Motor shaft 12 extends into a hub 79 of the impeller. A stainless steel screw 80 extends through the hub and is threaded into the motor shaft to hold the impeller onto the shaft. Since the down flow of water which occurs when the motor is deenergized does not tend to rotate the impeller there is no danger of the screw unscrewing by reason of such a reverse rotation.

For some installations it is desirable to have a screen about the pump draw pipe to prevent floating debris from entering the draw pipe. Such a screen is formed by a second length 81 of a pipe of the same size as that of main pipe 43; in the example given, it being four inch pipe. This second length of pipe has a plurality of openings 82 in the lower part thereof. These openings are sufficiently small to prevent the normal debris from entering the screen pipe 81. A suitable size is seven-sixteenths inch in diameter. The screen pipe 81 slips onto the exposed portion of sleeve 64 of the bottom reducer and is held in place by friction. The holes are adjacent one end of the screen pipe. Thus by reversing the screen pipe end-for-end, the screen may be positioned high or low in the sump to accommodate different installation requirements.

By way of illustrating the various ways in which embodiments of the invention may be employed, reference may be first made to FIG. 1 which shows a sump 85 in which water 86 may accumulate from time to time. This sump is, for example, a pit in a basement floor 87 and has a bottom 88. If it is desired to have the pump be self-supporting on the bottom of the sump, a plurality (e.g., three) of rubber feet 90 may be affixed to the bottom of the screen pipe 81. These feet are items such as crutch tips or chair leg tips in which there is a slot 91. The slot is of such a width that the upper part of the feet will slip over the screen pipe 81 and be frictionally secured thereto. Thus the pump is supported on the pit bottom 88 with the screen pipe 81 spaced a short distance from the bottom of the sump. The discharge pipe 57 connected to the top of the pump will ensure that the pump does not upset within the sump.

Alternatively, the pump may extend through a floor plate 93 covering the top of the sump. A ring 94 secured to the main pipe 43 and resting upon the floor plate 93 may be used to suspend the pump within the sump. In that event, it is not necessary for the bottom of the pump (or the feet 90) to bear against the bottom of the sump. The ring 94 may be of elastomeric material, frictionally engaging the main pipe 43. The connection to pipe 57 will also bear some of the weight of the pump in addition to the support provided by ring 94.

Figure 4:
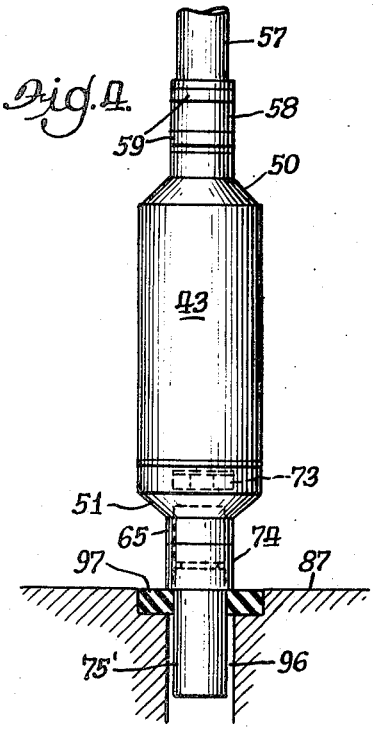
Figure 2:
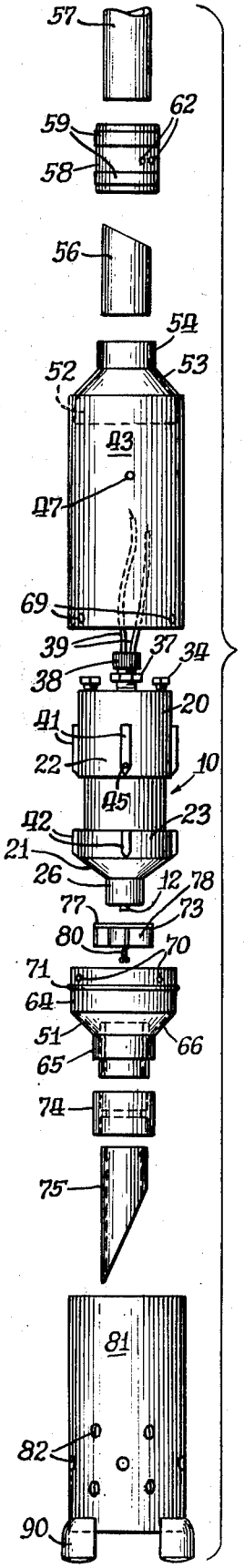
FIG. 2 is an exploded view of the pump embodiment of FIG. 1.
Figure 3:
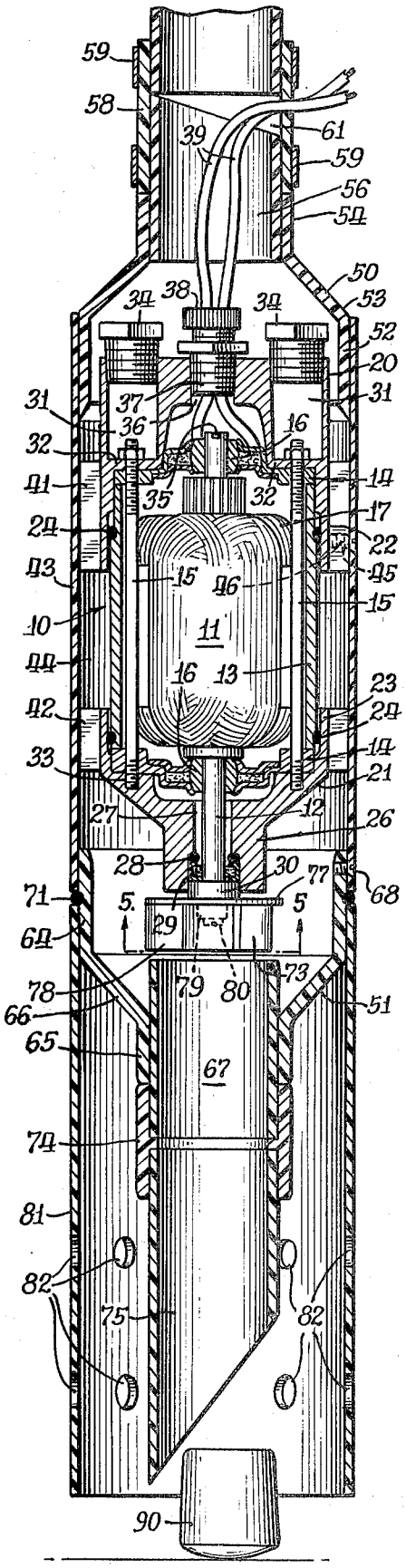
FIG. 3 is a longitudinal section through the embodiment of FIG. 1.

FIG. 4 illustrates the manner in which the pump may be employed much in the form of a standpipe to prevent a back flow in a floor drain 96 or the like in a basement floor 87. In this instance a draw pipe 75' having a straight bottom is inserted into coupling 74. It projects through an opening in an elastomeric gasket 97 which is placed in the cavity intended to hold the floor plate of the floor drain. If water begins to back up into the floor drain 96 the pump may be turned on (manually or automatically) to remove that water to another location for discharge.

Figure 6:
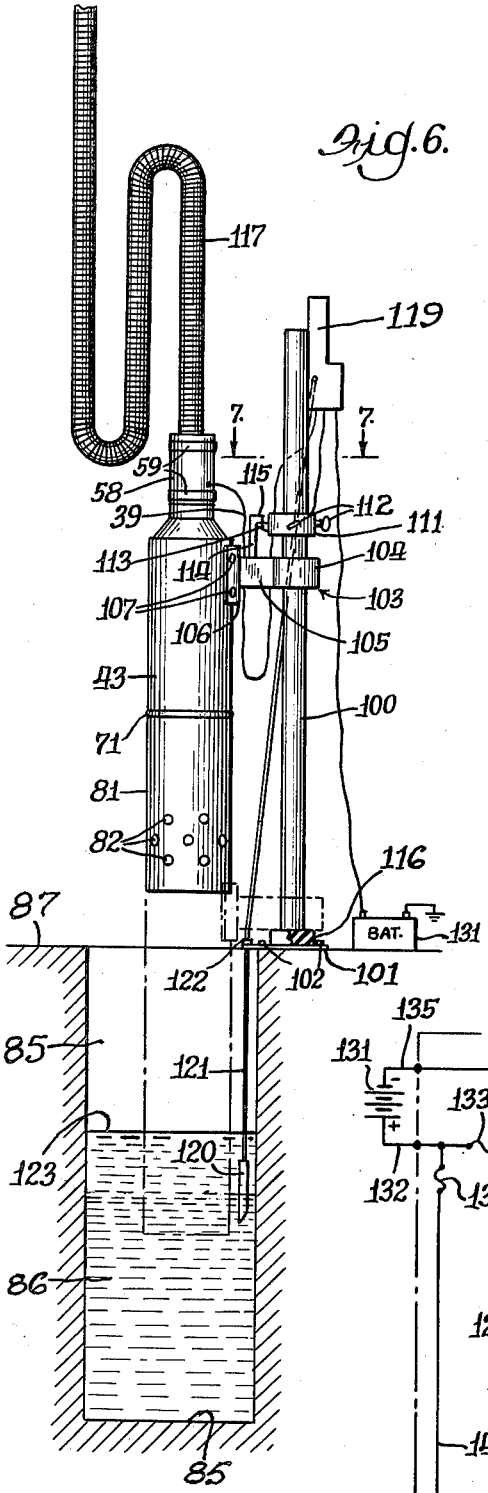
FIG. 6 is an elevational view of an embodiment wherein the pump is held outside of the sump until it is necessary that the water removal occur.
Figure 5:
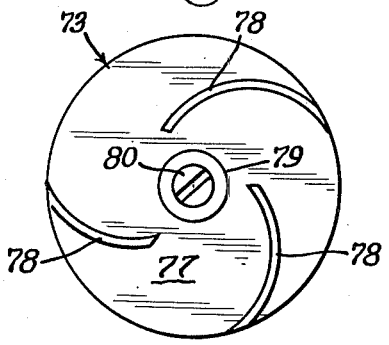
FIG. 5 is a view as seen at line 5—5 of FIG. 3.
Figure 7:
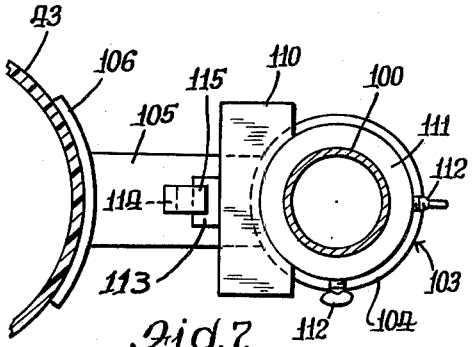
FIG. 7 is a view as seen at line 7—7 of FIG. 6.

FIGS. 6 and 7 illustrate the manner in which the pump is employed, when it is desired that the pump normally be out of the water except when it is in use, thereby preventing any deleterious action to the pump as a result of its standing in the water. A vertical track 100 defining a vertical way is mounted adjacent the sump 85. In the illustrated embodiment this track is formed by a pipe secured to a floor plate 101. The floor plate is suitably attached to the floor 87 as by means of bolts 102. A carriage 103 is vertically movable along the track 100. This carriage comprises a ring 104 which encircles pipe 100, an arm 105 extending out from the ring and a saddle 106 on the end of the arm. Screws 107 extend through openings in the saddle and are threaded into the main pipe 43 to support the pump in the saddle. The ring 104 is free to slide up and down the pipe 100. In some embodiments vertical guides may be employed to prevent the rotation of the ring about the pipe, and ball bearings or other antifriction means may be employed to ensure that the carriage moves easily along its track.

An electric latch 110 is secured to a mounting ring 111. Ring 111 has thumbscrews 112 to engage track 100 to fix the ring's position on the track. The electric latch 110 is similar to the electric latches commonly used to prevent a door from opening except when the latch is energized. It includes a tongue 113 which is outwardly spring biased and is retracted inwardly when a solenoid in the latch is energized. A support 114 is secured to arm 105 of the carriage and has a finger 115 which hooks over tongue 113 to normally support the carriage, and thus the pump, in the full line position illustrated in FIG. 6. When the solenoid of latch 110 is energized, thereby retracting tongue 113 from below the finger 115, the carriage 103 is released to descend along track 100. A rubber bumper 116 is placed about track 100 at the bottom thereof to cushion the descent of the carriage. Counterweights may be employed if desired to slow the descent of the carriage and pump along the track. A flexible hose 117 serves as the discharge conduit for the pump and is sufficiently long to permit movement of the pump between the raised and lowered positions. It is affixed by being clamped within hose 58 (or it may be clamped directly to pipe 56 in place of hose 58). Wires 39 to the motor also are sufficiently long to permit the vertical movement of the pump.

The controls for the pump are in a control box 119 at a suitable location, as for example atop the pipe track 100. These controls include a sensor for determining when the water 86 rises to a level within the sump such that the pumping should commence. A part of this sensor is positioned in the sump. In the illustrated embodiment, the sensor is pneumatically operated and the part thereof within the sump comprises a bell 120 having an open bottom. The interior of the bell communicates with a tube 121. This tube is used to suspend the bell within the sump. Thus, a portion of the mounting plate 101 extends over the sump and the tube 121 passes through that portion.

A clamp 122 is placed about the tube at a location at which the bell 120 will be suspended at a height such that a sensor will signal the controls when the water has risen to a level such that pumping should commence. Thus assume that the line 123 represents the elevation selected for the commencement of the pumping operation. The bell 120 is suspended so that its bottom open end is below the level 123. As the water rises above the bottom end of the bell, air is trapped in the bell and as the water level continues to rise, the air pressure in the bell correspondingly increases. This air pressure is transmitted through tube 121 to a pneumatic pressure detector.

Figure 8:
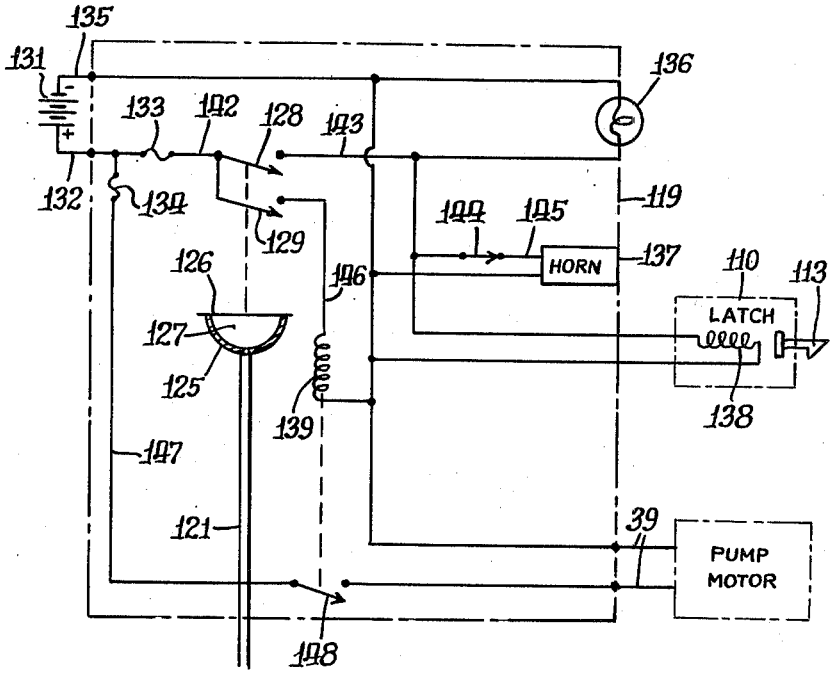
FIG. 8 is a schematic of the electrical control apparatus for the embodiment of FIG. 6.

The control apparatus is schematically illustrated in FIG. 8. The pneumatic detector comprises a housing 125 across which is a diaphragm 126, the two defining a pressure chamber 127. Tube 121 communicates with this chamber. As the pressure in the bell 120 increases the diaphragm 126 is moved outwardly, first closing switch 128 and with a further increase in water level then closing switch 129. Such an air pressure detector apparatus which will actuate different switches at different pressures is disclosed in my pending U.S. patent application Ser. No. 751,476, filed Dec. 16, 1976, and entitled Air Pressure Switch Signaling Two Different Pressure Conditions, the disclosure of which is included by reference.

In the illustrated embodiment, both the controls and the pump motor are operated from a 12 volt battery 131. One wire 132 from the battery connects to a pair of fuses 133 and 134. The other wire 135 from the battery connects to a signal light 136, a horn 137, the solenoid 138 of latch 110, a relay coil 139 and one of wires 39 going to the pump motor. A wire 142 connects fuse 133 to switches 128 and 129. A wire 143 connects switch 128 to light 136, horn switch 144 and solenoid 138 of latch 110. A wire 145 connects horn switch 144 and the horn. A wire 146 connects switch 129 and relay coil 139. A wire 147 connects fuse 134 and relay switch 148. The other of motor wires 39 is connected to the relay switch 148.

As previously mentioned, switches 128 and 129 are closed sequentially when the water in the sump rises to, or above, the level 123 at which pumping should commence. The closing of switch 128 completes the circuit to signal light 136, horn 137 and latch 110. The energizing of the latch solenoid retracts the tongue 113 of the latch permitting the carriage 103 and the pump suspended thereby to descend to the dot-dash line position illustrated in FIG. 6. The subsequent closing of switch 129 energizes relay coil 139. This closes relay switch 148 and energizes the pump motor through wires 39. Since the motor is not energized until after the pump is dropped into the water the possibility of the pump becoming air locked is avoided. In some embodiments relay 139, 148 may have another, normally-closed switch which is in series with solenoid 138 of the latch. That normally-closed switch will open when the relay is energized to shut off the power to the latch and thus reduce the drain on the battery.

The signals given by light 136 and horn 137 will alert the occupants to the problem so that they can observe the operation of the pump and make sure that everything will go well. The continued operation of the horn 137 may be distracting and the occupant can open switch 144 to silence the horn. When the emergency is over and the water level has dropped below the level indicated by line 123, switches 128 and 129 again open. This shuts off the pump motor and the various signaling devices. The occupant then manually raises carriage 103 to the full line position of FIG. 6. When this is done, the finger 115 again hooks over the tongue 113 of the latch to suspend the carriage and pump in the elevated position.

Figure 9:
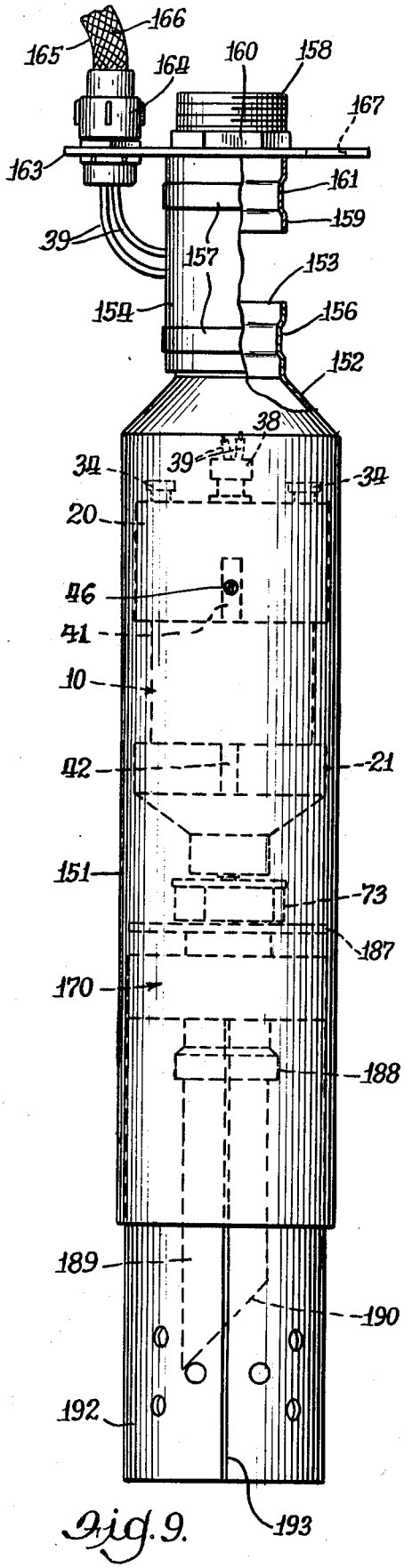
FIG. 9 is an elevational view, with portions broken away, of another embodiment.
Figure 10:
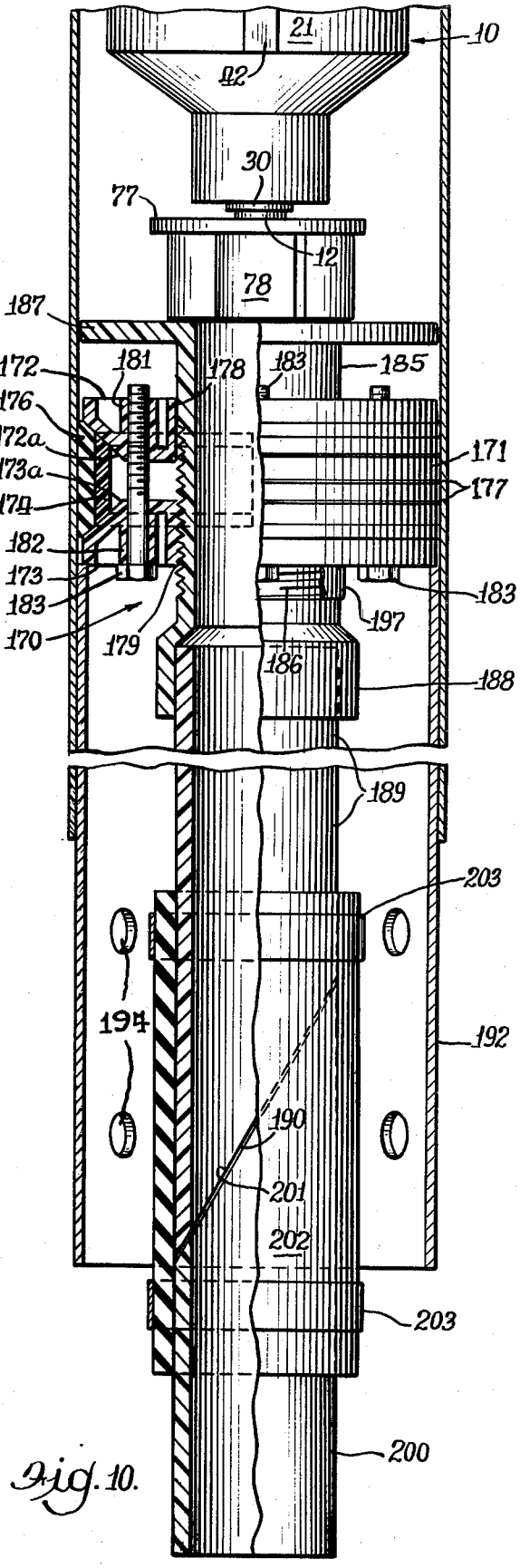
FIG. 10 is a longitudinal section of the lower portion of the embodiment of FIG. 9 illustrating an additional standpipe connection added thereto.

FIGS. 9 and 10 illustrate alternative constructions for the pump shell, the upper reducer, the lower reducer, etc., plus improvements in the intake conduit with respect to the impeller. It should be recognized that substantially any one of these can be employed with the remaining structure of the FIGS. 1-3 embodiment without necessarily using them all, and vice versa.

In the embodiment of FIGS. 9 and 10, the motor 10 and the impeller 73 employed therein are identical to those previously described. However, the shell 151 is a length of four inch I.D. copper pipe. One end of this length of pipe has been spun down to form reducer 152 with an upper neck 153. This neck substantially corresponds to a standard pipe size and is intended to receive a flexible hose 154. So that the hose will be securely attached to the neck, the neck is spun with a groove or depression 156. Thus as a hose clamp 157 is tightened about the hose, the hose is forced into the groove 156 so that a secure attachment is obtained.

While a length of hose so affixed to the shell can serve alone as the discharge conduit, the illustrated embodiment includes an additional connector having pipe threads 158 on the distal end, a neck 159 on the proximal end and an intermediate hexagonal portion 160 adapted for engagement by a wrench. Preferably, the neck 159 also includes a groove 161 so that hose clamp 157 will securely affix the hose 154 to the neck. A support plate 163 has a central opening sufficiently large to permit neck 159 to pass therethrough, but sufficiently small so that the upper side of the support plate will bear against the underside of the hexagonal portion 160 of the connector. At one side, the support plate has an opening to receive an end fitting 164 of an electrical cable 165. The fitting 164 has a mesh cable gripper 166 which securely holds the cable to the fitting when tension is pun on the cable as by way of supporting the pump unit thereby. At the opposite side of the support plate is an opening 167 which may be used to anchor a support rope or cable so that such strain on the electrical cable will not normally occur.

This embodiment is particularly suited for use in pumping out manholes or the like. For such an application, the end fitting of a discharge hose would be screwed onto the threads 158. The unit is then lowered through a manhole opening to the bottom of the manhole to pump out the manhole. When used in a permanent installation, a pipe fitting having a discharge pipe coupled thereto might be screwed onto threads 158.

In this embodiment, the reducer, generally 170, at the intake end of the shell 151 includes an expansion fitting 171 which frictionally engages the interior of the shell in a watertight manner and forms the large end of the reducer. This fitting comprises an upper disc 172 and a lower disc 173. The peripheral faces of the discs are somewhat smaller than the internal diameter of the pipe which they are to fit. Each disc has an annular cam face **172*a* and 173*a*, respectively, in the form of a frustum of a cone. Between the two discs are two semicylindrical pressure plates 174 having axial end faces which are complementary to and abut the cam faces 172***a* and 173*a*. The discs and the pressure plates are formed of a relatively rigid plastic. Externally of the pressure plate is an annular, elastomeric seal ring 176. This seal ring normally has an external diameter slightly smaller than the internal diameter of the shell 151, however, when it is expanded as hereinafter described, it securely engages the inner wall of the shell. The periphery of the seal ring has a plurality of small, annular ribs 177 to improve its engaging and sealing function.

The upper disc 172 has a smooth axial opening 178 while the lower disc has a threaded axial opening 179. The upper disc has four, internally threaded bosses 181 and the lower disc has four, smooth bosses 182. The four bosses are positioned ninety degrees apart in the azimuth about the axis. Stud bolts 183 slide through bosses 182 and are screwed into bosses 181.

A tube 185 having external threads 186 extends through the axial openings 178 and 179, which serves as an intake conduit means and the lower or external part of which serves as what may be referred to as the small end of the reducer. The upper end of the tube has a plate 187 normal to the axis of the tube. This plate is only slightly smaller in external diameter than is the internal diameter of the shell 151. The lower end of the tube has a coupling 188 to receive a pipe which is substantially smaller in diameter than is the internal diameter of the shell 151. In the illustrated embodiment, a pipe 189 forming the draw pipe is received in coupling 188 and secured therein by means of an adhesive. In the illustrated embodiment the tube 185 and pipe 189 have an internal diameter of one and three-quarter inches. Both are formed of relatively rigid plastic. The lower end of the draw pipe is tapered as seen at 190 as an aid toward avoiding blocking of the draw pipe.

The support pipe and screen 192 is formed of a length of metal or plastic pipe of the same nominal size as that of shell 151. This length has a small longitudinal segment cut out to define a slot 193. This permits the pipe to be diametrically squeezed to a sufficiently small size so that it will slip within the shell to a position at which it abuts the underside of lower disc 173. The pipe has sufficient resiliency so as to expand, when the squeezing force is removed, to engage the inner wall of the shell. By reason of its abutting the disc 173 of the reducer 170, it can be used to support the weight of the pump. Support pipe 192 has openings 194 corresponding to openings 82 of the previously described embodiment.

After the motor 10 with the impeller 73 mounted thereon has been secured in position in the shell 151, the reducer 170 is put into the shell. Before the reducer is inserted, the bolts 183 are loose and the tube 185 is rotated in a manner such as to cause the threads to draw the tube downwardly so that the plate 187 is relatively close to the upper disc 172. By having bolts 183 loose, the seal ring 176 is not deformed and is smaller than the internal diameter of the shell. The reducer 170 is then slipped into the shell and positioned so that the plate 187 is adjacent the impeller 73. Bolts 183 are then tightened. The tightening of these bolts draws the two discs 172 and 173 together. As they are drawn together, the cam faces 172*a* and 173*a* force the two pressure plates 174 radially outward. In turn, the pressure plates 174 expand the seal ring 176 and forces it tightly against the inner face of the shell. Thus by tightening the bolts 183 the reducer 170 securely engages the shell. In addition to obtaining this secure engagement, the seal ring provides a watertight seal between the discs and the shell.

After expansion fitting has thus been secured in place, the tube 185 is rotated in a direction such that it, and plate 187, are moved axially toward the impeller 73. For best pumping efficiency the plate 187 is positioned as close as possible to the impeller, without actual contact between the two.

In electric motors of the type described, there will be some axial end play in the motor shaft. The amount of such play, particularly in moderately priced motors, will not be identical in every motor even though each motor is presumably the same as the others. Since that end play will affect the axial position of the impeller 73, it will affect the spacing between the impeller and the inner end of the intake conduit and, with an arrangement such as that of FIGS. 1–3, that spacing must be sufficient to accommodate the motor with the greatest end play. Thus with motors having lesser end play the spacing will be greater than the optimum. This problem is avoided by the use of the adjustment just described. The plate 187 at the inner end of the intake conduit improves the pumping efficiency.

Some manufacturers or users will desire to wind several layers of plastic tape (commonly referred to as Polytetrafluoroethylene Tape for pipe thread sealing) about tube 185 and in abutment with the bottom of disc 173, a portion of those tape windings being seen at 197 to provide a water seal between the tube 185 and the disc 173.

If it is desired to use the embodiment of FIGS. 9 and 10 in a standpipe type installation, such as is illustrated in FIG. 4, the support pipe and screen 192 normally would not be used, but would be removed. A piece of pipe 200 of the same nominal pipe size as that of draw pipe 189 would be used and provided with a tapered end 201 corresponding to the taper 190. Pipe 200 would be aligned so that the two tapers 190 and 201 were mated and a hose 202 would be positioned over the two pipes. Hose clamps 203 would secure the hose to each of the two pipes. Of course, the pipe 200 could be of any desired length.

With hose 202 down over draw pipe 189 to just above screen 192 (but without extension pipe 200) it will act as a draw pipe and there can be manual pump down of flat areas to within one-half inch of a flat surface before the air intake breaks the pumping action. The bottom of the hose in such an arrangement may be at various levels above the bottom of taper 190 which permits an adjustment in the level to which the installation will pump down. After the desired level is selected the hose is clamped into position to retain the setting.

I claim:

1. A pump for use as a sump pump or the like in pumping a liquid and utilizing pipe of standard sizes of internal and external diameter about an axis, said pump comprising:

an electric motor including a waterproof housing of a given diameter, and a motor shaft defining an axis and with a portion of the shaft externally of said housing;

a pump impeller affixed to said portion of said shaft;

a length of a first size of said pipe having an internal diameter significantly greater in internal diameter than is said given diameter, said length surrounding said motor and having a first end adjacent the said impeller and a second end adjacent the other end of the motor;

means affixing the motor to the length of pipe and spacing said housing at all sides thereof from said pipe whereby there is space substantially all about said motor for the flow of liquid in a generally axial direction;

conduit means connected to said second end of said length of pipe and forming the discharge for said pump;

a reducer having a large end and a small end, said large end telescopically mating with and engaging said first end of said length of pipe, said small end being of a size substantially smaller than said given diameter and including conduit means extending to a location adjacent said impeller and forming the intake for said pump, said large end of said reducer being in the form of a cylindrical sleeve of an external diameter substantially corresponding to said given diameter and extending within said first end, and said small end of said reducer being in the form of a cylindrical sleeve having an internal diameter substantially corresponding to the external diameter of another of said standard sizes, said other standard size being substantially smaller than said first size, whereby the last mentioned sleeve can be used as a coupling for said other size, said first mentioned cylindrical sleeve extending only partially into said first end and having a portion externally of said first end;

another length of said pipe of said first size, said other length being telescopically mounted on said external portion, said other length having openings therethrough whereby said liquid may flow through said openings into the interior of the other length and the other length acts as a pump screen; and a piece of pipe of said other of said standard sizes telescopically mounted in said smaller of said sleeves and projecting outwardly therefrom and into said other pipe of said first size to serve as an intake conduit for said pump.

2. A pump as set forth in claim 1, wherein said piece of pipe of said other of said sizes extends into said reducer beyond the smaller of said sleeves and serves as said conduit means forming the intake for said pump; and including a coupling member mounted on the outwardly projecting part of said piece of pipe; and including another piece of pipe of said other of said standard sizes and having two ends, one of the latter ends being telescopically mounted in the coupling member and the other thereof being beveled across that end.

3. A pump as set forth in claim 1, wherein said conduit means includes:

a reducer at said second end and having a large end and a small end, said large end of said second end reducer is in the form of a cylindrical sleeve of an external diameter substantially corresponding to said given diameter and extending within said second end, and said small end of said second end reducer is in the form of a cylindrical sleeve having an internal diameter substantially corresponding to the external diameter of one of said standard sizes, said one standard size being substantially smaller than said first size, whereby the last mentioned sleeve can be used as a coupling for said one size.

4. A pump as set forth in claim 3, wherein said pipe is plastic.

5. A pump for use as a sump pump or the like in pumping a liquid and utilizing pipe, said pump comprising:

an electric motor including a waterproof housing of a given diameter, and a motor shaft defining an axis and with a portion of the shaft externally of said housing;

a pump impeller affixed to said portion of said shaft;

a length of a first size of said pipe having an internal diameter significantly greater in internal diameter than is said given diameter, said length surrounding said motor and having a first end adjacent the said impeller and a second end adjacent the other end of the motor;

means affixing the motor to the length of pipe and spacing said housing at all sides thereof from said pipe whereby there is space substantially all about said motor for the flow of liquid in a generally axial direction;

a reducer having a large end and a small end, said large end telescopically mating with and engaging said first end of said length of pipe, said small end being of a size substantially smaller than said given diameter and including conduit means extending to a location adjacent said impeller and forming the intake for said pump, said conduit means including a reducer at said second end and having a large end and a small end substantially axially aligned, said large end of said second end reducer being of a size substantially corresponding to that of said first size, and said small end of said second end reducer is in the form of cylindrical sleeve means substantially smaller than said first size;

conduit means connected to said second end of said length of pipe and forming the discharge for said pump;

whereby the liquid pumped flows about said motor to cool the motor;

a piece of hose slipped onto said sleeve means, and a hose clamped onto said sleeve means and having a portion beyond the sleeve means; and said motor having wire means extending therefrom for use in supplying electric power to the motor, said wire means extending from said motor through said sleeve means and out through the side of the hose.

6. A pump as set forth in claim 5, including a pipe connector having a sleeve integral therewith and of substantially the same size as said sleeve means, said hose having a distal end clamped to said connector sleeve.

7. A pump as set forth in claim 5, wherein said sleeve means has a distal end with slot in a side thereof, said wire means extending from said motor through said slot and through said hose opposite said slot.

8. A pump for use as a sump pump or the like in pumping a liquid and utilizing pipe, said pump comprising: an electric motor including a waterproof housing of a given diameter, and a motor shaft defining an axis and with a portion of the shaft externally of said housing, said motor including an armature within said housing and a frame comprising a cylindrical shell about said armature, means at each end of the shell for rotatably supporting the armature, and bolts extending within the shell and through the frame and holding said supporting means unitary with the shell, said motor being characterized by:

caps positioned at each end of said frame respectively, each cap having a skirt extending from the respective end toward the opposite end and outside and in immediate juxtaposition to said shell, said bolts extending from cap to cap and holding the caps in assembled condition on said frame as well as holding said supporting means unitary with said shell, one of said caps having an opening through which said shaft extends; and sealing means including O-rings between said skirts and said shell and a shaft seal between the shaft and said one cap;

whereby said shell and said caps form said waterproof housing;

a pump impeller affixed to said portion of said shaft;

a length of a first size of said pipe having an internal diameter significantly greater in internal diameter than is said given diameter, said length surrounding said motor and having a first end adjacent to said impeller and a second end adjacent the other end of the motor;

means affixing the motor to the length of pipe and spacing said housing at all sides thereof from said pipe whereby there is space substantially all about said motor for the flow of liquid in a generally axial direction;

a reducer having a large end and a small end, said large end telescopically mating with and engaging said first end of said length of pipe, said small end being of a size substantially smaller than said given diameter and including conduit means extending to a location adjacent said impeller and forming the intake of said pump;

conduit means connected to said second end of said length of pipe and forming the discharge for said pump;

whereby the liquid pumped flows about said motor to cool the motor.

9. A pump as set forth in claim 8, wherein at least part of said caps being generally cylindrical about an axis with the exterior thereof having a radius substantially smaller than half said internal diameter, said caps including bosses extending radially outwardly at spaced intervals thereabout, the bosses having distal ends at a radial distance from said axis substantially corresponding to half said internal diameter, one of said bosses having a threaded opening extending radially inward from said distal end, said one boss forming part of said means affixing the motor.

10. A pump as set forth in claim 8, wherein said motor has wire means extending through the other of said caps for supplying electric power to the motor; and wherein said conduit means includes:

a reducer at said second end and having a large end and a small end, said large end of said second end reducer is of a size substantially corresponding to that of said first size and said small end of said second end reducer is in the form of cylindrical sleeve means of a size substantially smaller than said first size, a piece of hose slipped into said sleeve means, and a hose clamp on said piece of hose, said wire means extending from said motor through said second end reducer and out through the side of said hose.

11. In an electric motor apparatus for use in liquid and comprising an armature and having a shaft extending substantially beyond one end thereof, a motor frame about said armature and including a cylindrical shell and means at each end of the shell for rotatably supporting the armature, said frame having two ends with said shaft extending outwardly beyond one of said ends, and bolts extending within the shell and through the frame and holding said means unitary with said shell, the improvement comprising:

caps positioned at each end of said frame respectively, each cap having a skirt extending from the respective end toward the opposite end and outside and in immediate juxtaposition to said shell, said bolts extending from cap to cap and holding the caps in assembled condition on said frame as well as holding said means unitary with said shell, one of said caps having an opening through which said shaft extends; and sealing means including O-rings between said skirts and said shell and a shaft seal between the shaft and said one cap;

whereby a standard production motor may be made fit for use in liquid by the addition of said caps and sealing means.

12. In an apparatus as set forth in claim 11, wherein a first of said caps has threaded, blind openings on the interior thereof to receive said bolts, the second of the caps has a wall with openings through which said bolts extend, and including means associated with said second cap for preventing the entry of water from the exterior of the cap through said openings in said second cap into the motor.

13. In an apparatus as set forth in claim 12, wherein said second cap has threaded bores extending from the exterior of said cap and in axial alignment with said bolts, said walls being at the interior of said bores, and wherein said means for the prevention of the entry of water includes threaded plugs screwed into said threaded bores.

14. In an apparatus as set forth in claim 11 and for use in a water conduit having a given internal radius, the further improvement comprising:

at least part of said caps being generally cylindrical about an axis with the exterior thereof having a radius substantially smaller than said internal radius, said caps including bosses extending radially outwardly at spaced intervals thereabout, the bosses having distal ends at a radial distance from said axis substantially corresponding to said internal radius, said bosses having threaded openings extending radially inward from said distal ends.

15. In an apparatus as set forth in claim 14 and including a pump impeller secured to the distal end of said shaft, the further improvement:

wherein said impeller comprises an annular plate having two sides and of a peripheral diameter substantially larger than the diameter of said opening in said one cap, one of said sides being in juxtaposition to said one cap, and a plurality of vanes extending from the other side of said plate.

16. A pump for use as a sump pump or the like and comprising:

a pump housing formed about a generally vertical axis and including, a cylindrical portion having a given diameter about said axis and having an upper end and a lower end and defining a motor and pump chamber therebetween, upper reducer means at the upper end of said portion and comprising a cylindrical sleeve having a diameter about said axis that is substantially smaller than said given diameter and a truncated conical connecting portion extending from said sleeve to the upper end of said portion, and lower reducer means below said motor and pump chamber and secured to said portion, said lower reducer means including a tube substantially smaller than said given diameter and coaxial with said axis;

a draw pipe connected to said tube and extending down to form the intake for the pump;

an electric motor within said pump chamber and including a motor housing smaller in diameter than is the pump chamber whereby the water being pumped may flow up from the lower reducer means, through said chamber and about the motor, and exit from the chamber out the upper reducer means, said motor having a downwardly extending shaft along said axis;

radially positioned spacer means between the motor housing and the pump housing to so position said motor in the chamber, said spacer means being secured to both said motor housing and to said pump housing to affix the motor axially in the pump housing;

a pump impeller above the lower reducer and secured to the motor shaft;

a length of pipe of substantially the same diameter as said cylindrical portion, engaging the pump housing and extending downwardly therefrom about said draw pipe, said length of pipe having openings therethrough for the flow of liquid and forming a screen about said draw pipe; and rubber feet having slots in the top thereof and positioned at spaced intervals about the bottom of said length of pipe, said length of pipe extending into said slots and engaging said feet.

* * * * *

UNITED STATES PATENT AND TRADEMARK OFFICE

CERTIFICATE OF CORRECTION

PATENT NO. : 4,177,021

DATED : December 4, 1979

INVENTOR(S) : Karl O. Niedermeyer

It is certified that error appears in the above-identified patent and that said Letters Patent are hereby corrected as shown below:

Column 8, line 44, "pun" should read --put--.
Column 13, line 19, "to" should read --the--.
Column 15, line 9, "coaxial with said axis;" should not be a paragraph.

Signed and Sealed this

*Eighth* Day of *April 1980*

[SEAL]

*Attest:*

SIDNEY A. DIAMOND

*Attesting Officer*

*Commissioner of Patents and Trademarks*